US009918542B2

(12) United States Patent
Griffith

(10) Patent No.: US 9,918,542 B2
(45) Date of Patent: Mar. 20, 2018

(54) HAT ATTACHMENT CLIP

(71) Applicant: James Stewart Griffith, Seattle, WA (US)

(72) Inventor: James Stewart Griffith, Seattle, WA (US)

( * ) Notice: Subject to any disclaimer, the term of this patent is extended or adjusted under 35 U.S.C. 154(b) by 161 days.

(21) Appl. No.: 14/484,526

(22) Filed: Sep. 12, 2014

(65) Prior Publication Data

US 2015/0115008 A1 Apr. 30, 2015

Related U.S. Application Data

(63) Continuation-in-part of application No. 14/287,609, filed on May 27, 2014, now Pat. No. 9,289,052.

(60) Provisional application No. 61/897,750, filed on Oct. 30, 2013.

(51) Int. Cl.
*A45F 5/02* (2006.01)
*A45F 5/06* (2006.01)

(52) U.S. Cl.
CPC ..... *A45F 5/021* (2013.01); *A45F 5/06* (2013.01)

(58) Field of Classification Search
CPC ..... A45F 2005/026; A45F 5/02; A45F 5/06; A45F 2200/055; A45F 2005/025; Y10T 24/45094
USPC ..... 224/197, 268–269
See application file for complete search history.

(56) References Cited

U.S. PATENT DOCUMENTS 1,324,308 A * 12/1919 Crossan ..... B43K 23/001 24/11 CT
4,358,036 A * 11/1982 Maltais ..... A45F 5/02 224/163
4,746,042 A * 5/1988 King ..... A45F 5/02 224/148.2
8,272,612 B2 * 9/2012 Thorpe ..... A24F 13/22 24/336
2013/0232923 A1 * 9/2013 Beversluis ..... B65F 1/06 53/492
2014/0305976 A1 * 10/2014 Stallworth ..... A45F 5/021 224/269

* cited by examiner

*Primary Examiner* — Adam Waggenspack
(74) *Attorney, Agent, or Firm* — Dale J. Ream

(57) ABSTRACT

A hat attachment clip includes a front portion having first and second clip members, each having opposed proximal and distal ends. A first bridge member couples proximal ends of the first and second clip members together, respectively. The first and second clip members define an open space therebetween proximate the first bridge member. The distal ends of the first and second clip members are biased toward one another. The hat attachment clip includes a rear portion releasably and rotatably coupled to the front portion having third and fourth clip members, each having opposed proximal and distal ends. A second bridge member couples proximal ends of the first and second clip members together, respectively. The third and fourth clip members define an open space therebetween proximate the second bridge member. The distal ends of the third and fourth clip members are biased toward one another.

15 Claims, 14 Drawing Sheets

HAT ATTACHMENT CLIP

CROSS REFERENCE TO RELATED APPLICATION

This patent application is a Continuation-in-Part and claims the priority of U.S. Non-provisional patent application Ser. No. 14/287,609 filed May 27, 2014 which claims the priority of U.S. Provisional Patent Application No. 61/897,750 filed on Oct. 30, 2013 titled "Attachment Clip" which is incorporated by reference in its entirety herein.

BACKGROUND OF THE INVENTION

The present invention relates to hat attachments and, more particularly, to hat attachment clips that enable a person to removably couple a hat to an article of clothing such as a belt.

Once a hat is taken off a person's head, he either has to hold it in his hand, fold or squeeze it into a pocket or bag, or place it somewhere not on their person. In all these situations, the hat becomes either a burden or the hat may be misplaced. Alternatively, the hat must continue to be worn on his head, which may be inappropriate in some circumstances.

Various devices have been proposed in the prior art for holding a hat when removed from a person's head. Most notably, a hat rack having multiple prongs or rods extending away from a central post is useful for holding coats, hats, or the like. Although assumably effective for their intended purposes, the existing or proposed devices are still ineffective when a person desires to stow a hat while remote from a traditional hat and coat rack.

Therefore, it would be desirable to have a hat attachment clip that enables a person to secure a hat to an article of clothing when it is no longer desired to wear the hat on his head. Further, it would be desirable to have a hat attachment clip having a double clip configuration in which a rear portion is selectively attached to an article of clothing such as a belt and a front portion configured to receive and secure a hat.

SUMMARY OF THE INVENTION

A hat attachment clip according to a preferred embodiment of the present invention includes a front portion having a first clip member and a second clip member, each having opposed proximal and distal ends. A first bridge member couples proximal ends of the first and second clip members together, respectively. The first and second clip members define an open space therebetween proximate the first bridge member. The distal ends of the first and second clip members are biased toward one another. The hat attachment clip includes a rear portion rotatably coupled to the front portion having a third clip member and a fourth clip member, each having opposed proximal and distal ends. A second bridge member couples proximal ends of the first and second clip members together, respectively. The third and fourth clip members define an open space therebetween proximate the second bridge member. The distal ends of the third and fourth clip members are biased toward one another. In an embodiment, the rear portion is releasably coupled to the front portion.

Therefore, a general object of this invention is to provide a hat attachment clip having a rear portion selectively received onto a person's belt and a front portion that selectively receives and holds a hat of the type having a brim.

Another object of this invention is to provide a hat attachment clip, as aforesaid, that provides a secure place for a person's hat when removed from the person's head.

Still another object of this invention is to provide a hat attachment clip, as aforesaid, that is selectively configured to hold a hat at any selected angle relative to a person's belt to which the hat attachment clip is attached.

Yet another object of this invention is to provide a hat attachment clip, as aforesaid, in which adjacent clip members are biased toward one another so as to exert a retention force sufficient to hold the brim of a hat or other items.

A further object of this invention is to provide a hat attachment clip, as aforesaid, in which the front portion may be swiveled relative to the rear portion.

A still further object of this invention is to provide a hat attachment clip, as aforesaid, that is cost-effective to manufacture and easy to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
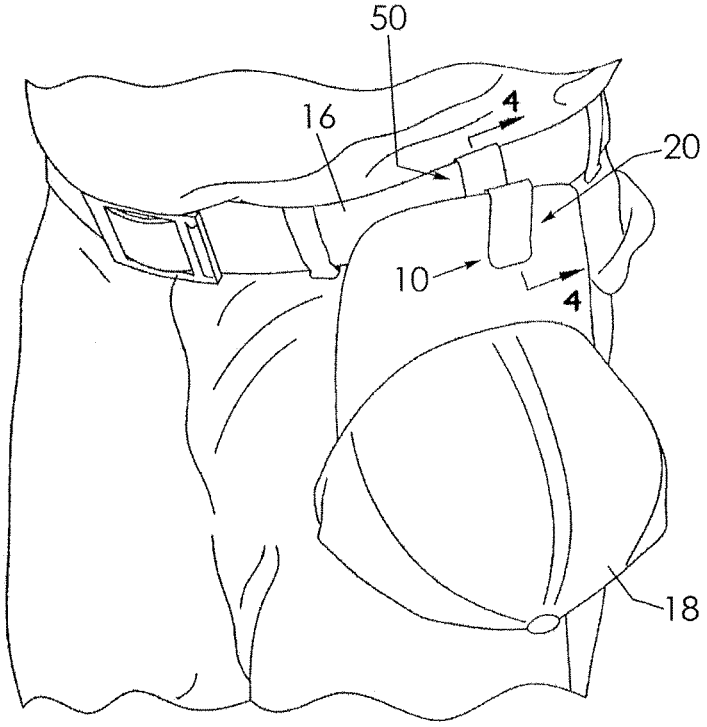
FIG. 1 is a perspective view of a hat attachment clip according to a preferred embodiment of the present invention illustrated in use attached to an article of clothing of a person.

A hat attachment clip according to a preferred embodiment of the present invention will now be described in detail with reference to FIGS. 1 to 18 of the accompanying drawings. The following detailed description of the best modes of carrying out exemplary embodiments of the invention are not to be taken in a limiting sense, but is made merely for the purpose of illustrating the general principles of the invention.

In one embodiment, the hat attachment clip 10 includes a front portion 20 having first 30 and second 36 clip members, the front portion 20 being rotatably coupled to a rear portion 50 having third 52 and fourth 58 clip members. The clip members of the front portion 20 and rear portion 50 are connected by first 42 and second 64 bridge members, respectively, and biased toward one another.

Figure 2:
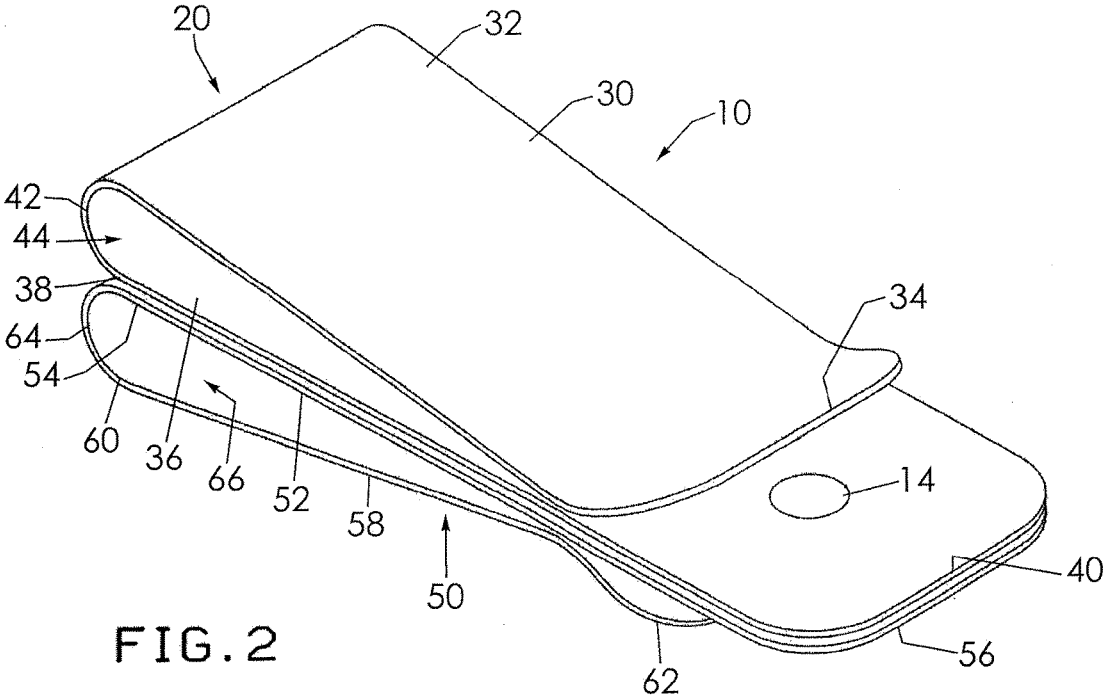
FIG. 2 is a perspective view of the hat attachment clip as in FIG. 1 removed from the clothing and shown in a non-rotated start configuration.

The front portion 20 of the hat attachment clip 10 includes a first clip member 30 having opposed proximal 32 and distal 34 ends. The first clip member 30 has a generally planar configuration and generally rectangular shape. The front portion 20 of the hat attachment clip 10 also includes a second clip member 36 having proximal 38 and distal 40 ends and also has a generally planar and rectangular configuration. Respective proximal ends 32, 38 are coupled together by the first bridge member 42, the first bridge member 42 having a curved or rounded configuration that positions the first clip member 30 and second clip member 36 in a generally parallel configuration. The first bridge member 42 displaces proximal ends 32, 38 of the first 30 and second 36 clip members, respectively, so as to define a first interior space 44 (FIG. 2).

The first 30 and second 36 clip members may be constructed of spring steel or an equivalent material that is configured so that respective proximal ends 32, 38 thereof are normally biased toward one another and may even bear against one another. Stated another way, the first clip member 30 exerts a retention force in the direction of the second clip member 36. The distal ends of the first clip member 30 and second clip member 36 are selectively movable between a closed configuration that blocks reception of the brim of a hat therebetween and an open configuration in which the brim of a hat is received between the distal ends 34, 40 of the first 30 and second 36 clip members.

Similarly, the rear portion 50 of the hat attachment clip 10 includes a third clip member 52 having opposed proximal 54 and distal ends 56. The third clip member 52 has a generally planar configuration and generally rectangular shape. The rear portion 50 of the hat attachment clip 10 also includes a fourth clip member 58 having proximal 60 and distal 62 ends and also has a generally planar and rectangular configuration. Respective proximal ends 54, 60 are coupled together by the second bridge member 64, the second bridge member 64 having a curved or rounded configuration that positions the third clip member 52 and fourth clip member 58 in a generally parallel configuration. The second bridge member 64 displaces proximal ends 54, 60 of the third 52 and fourth 58 clip members, respectively, so as to define a second interior space 66 (FIG. 2).

Figure 3:
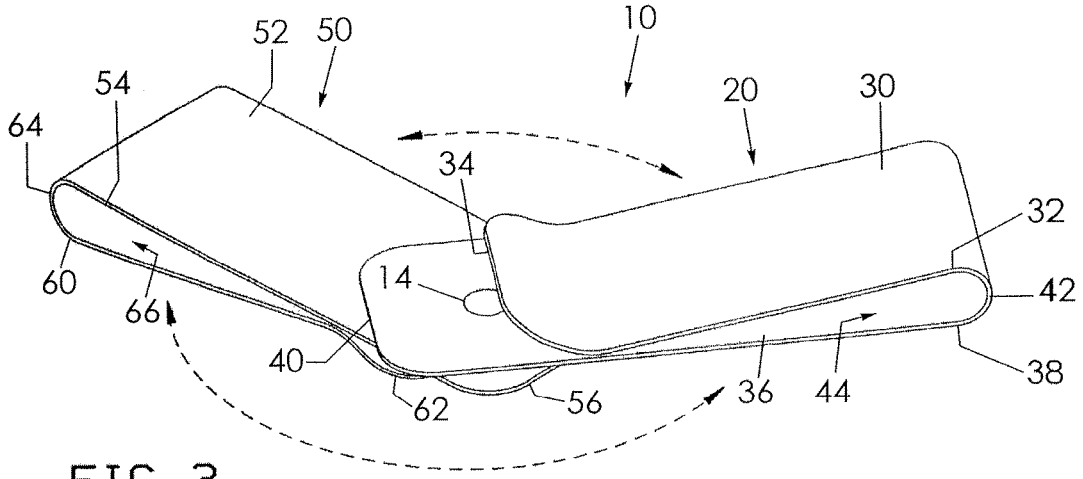
FIG. 3 is a perspective view of the hat attachment clip as in FIG. 2 shown in an angled configuration.

The front portion 20 defines an imaginary longitudinal axis. Likewise, the rear portion 50 defines an imaginary longitudinal axis. As the front portion 20 is rotatably coupled to the rear portion 50, the front portion 20 is movable between a start configuration in which the first longitudinal axis is parallel to the second longitudinal axis (FIG. 2) and an angled configuration in which the first longitudinal axis is rotatably displaced from the second longitudinal axis (FIG. 3). In other words, the front portion 20 can be selectively swiveled or rotated relative to the rear portion 50.

Figure 9:
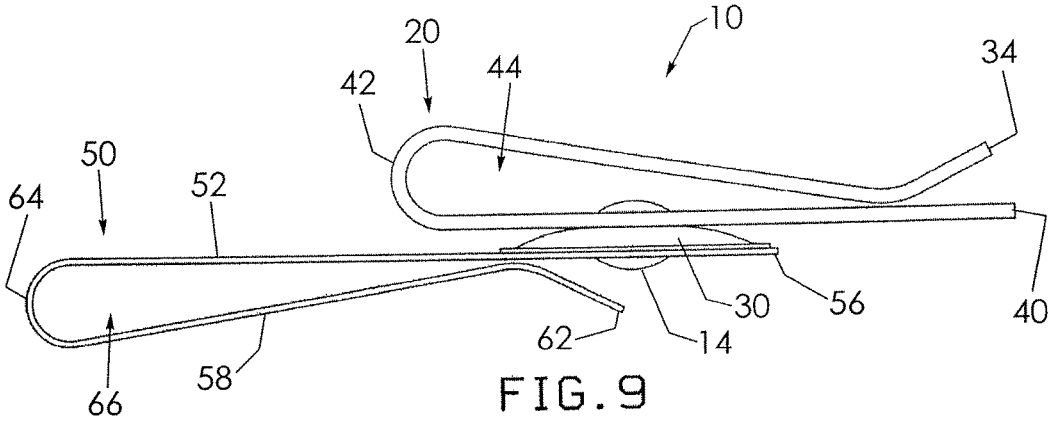
FIG. 9 is a side view of the hat attachment clip as in FIG. 8.
Figure 10A:
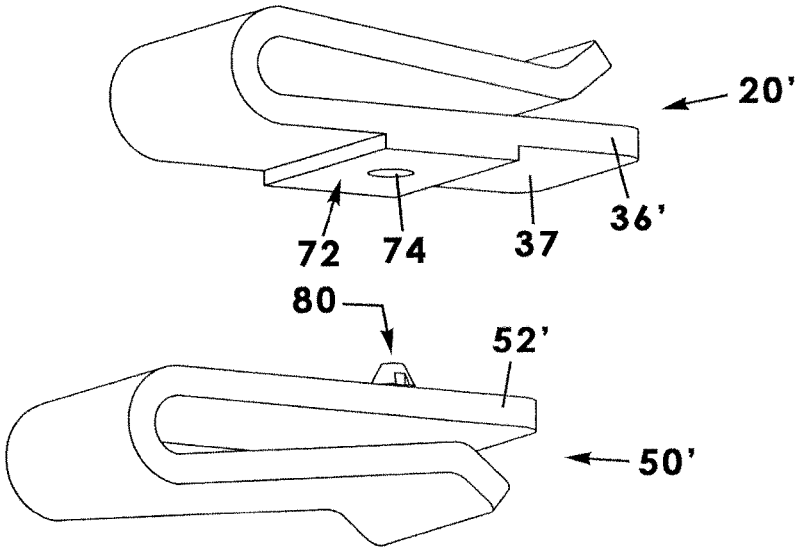
FIG. 10*a* is an exploded view of a hat attachment clip according to another embodiment of the present invention.
Figure 10B:
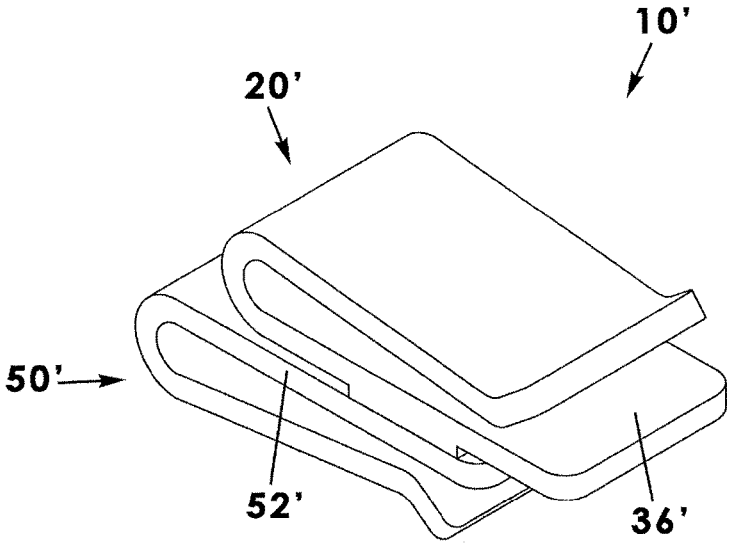
FIG. 10*b* is a perspective view of the hat attachment clip as in FIG. 10*a;*

With further reference to the selectively rotatable front 20 and rear 50 portions, the distal end 34 of the first clip member 30 is adjacent the distal end 56 of the third clip member 52 when the front portion 20 is at the start configuration (FIG. 2). By contrast, the distal end 34 of the first clip member 30 is swiveled away from the distal end 56 of the third clip member 52 when the front portion 20 is at the angled configuration (FIG. 3). In one embodiment, the distal end 34 of the first clip member 30 is positioned along the first longitudinal axis but is forwardly displaced from the distal end 56 of the third clip member 52 at the start configuration (FIG. 9).

The third 52 and fourth 58 clip members may be constructed of spring steel or an equivalent material that is configured so that respective proximal ends 54, 60 thereof are normally biased toward one another and may even bear against one another. Stated another way, the third clip member 52 exerts a retention force in the direction of the fourth clip member 58. The distal ends of the third clip member 52 and fourth clip member 58 are selectively movable between a closed configuration that blocks reception of an article of clothing therebetween, e.g. a belt, and an open configuration in which the article of clothing is received between the distal ends 34, 40 of the first 30 and second 36 clip members.

The front portion 20 of the hat attachment clip 10 is rotatably mounted to the rear portion 50 of the hat attachment clip 10 with a fastener 14 such as a rivet such that the front portion 20 may selectively swivel relative to the rear portion 50. In other words, the rivet attachment means enables the front portion 20 to move between the start configuration and the selectively angled configuration as described above. In other embodiments, the front portion 20 may be rotatably coupled to the rear portion 50 using a fastener taken from the group that includes a bolt, a pin, a disk, a tab, a rotatable bearing or the like.

Figure 5:
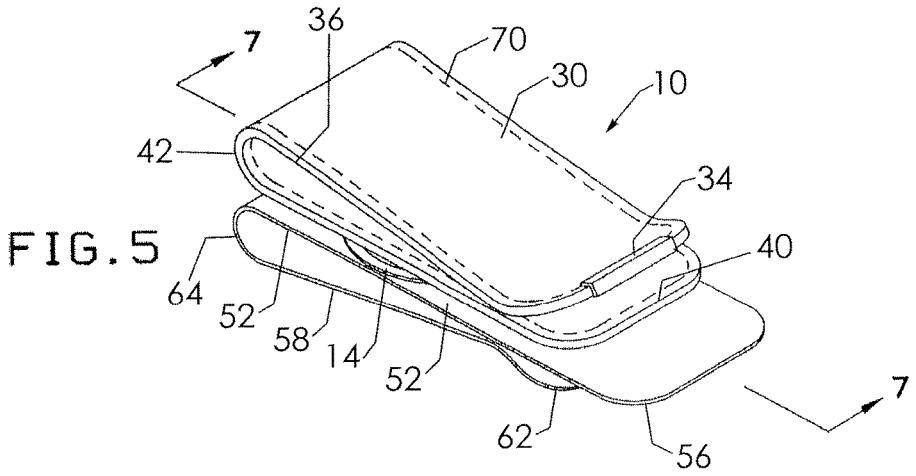
FIG. 5 is a perspective view of the hat attachment clip according to another embodiment of the present invention illustrated in a start configuration.
Figure 6:
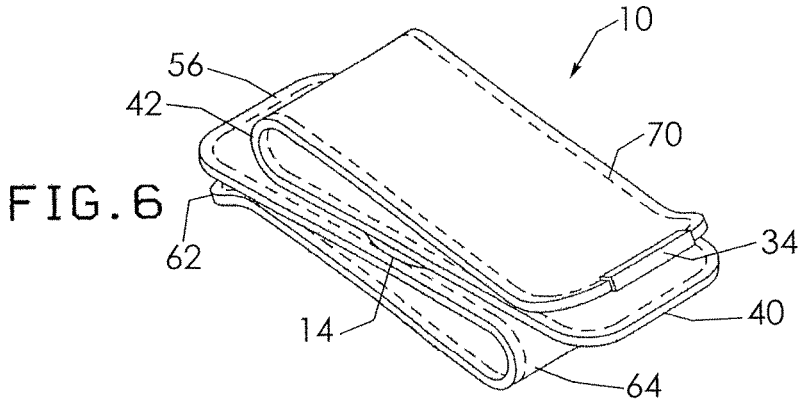
FIG. 6 is another perspective view of the hat attachment clip as in FIG. 5 illustrated in an angled or rotated configuration.
Figure 7:
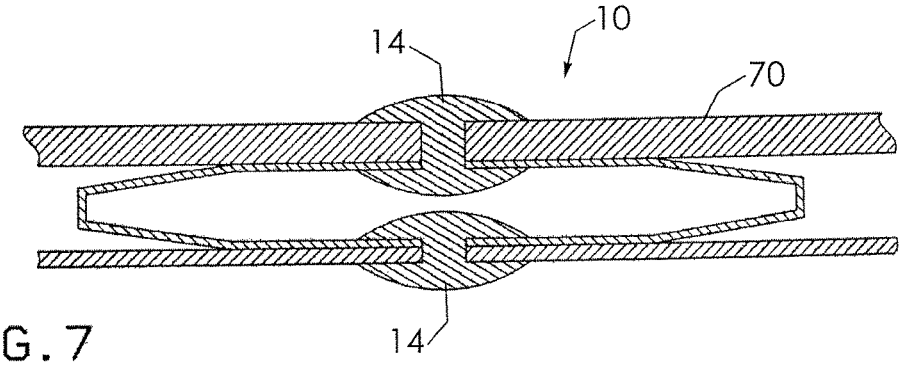
FIG. 7 is a sectional view taken along line 7-7 of FIG. 5.
Figure 8:
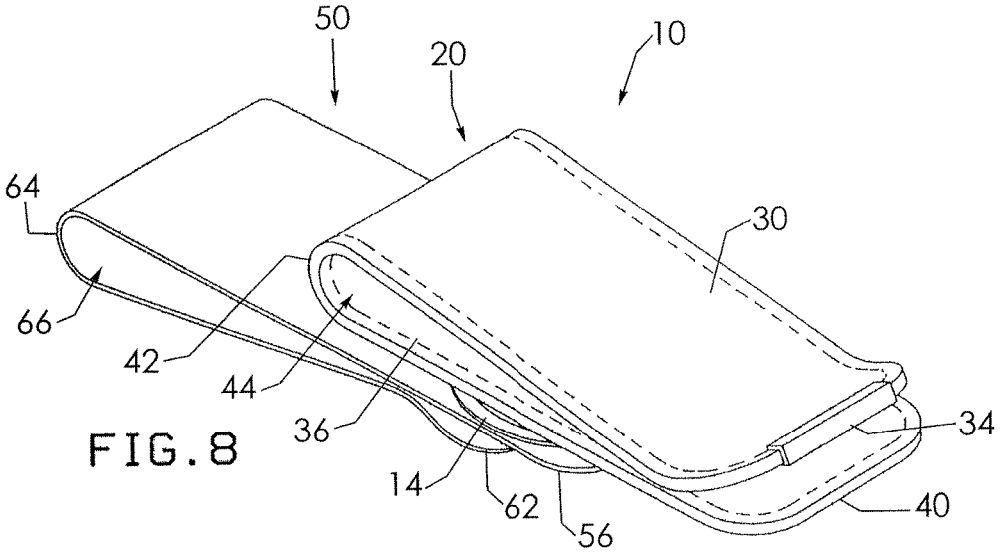
FIG. 8 is a perspective view of the hat attachment clip according to another embodiment of the present invention illustrated in a start configuration.

In one embodiment, the fastener 14 is situated proximate respective distal ends 40, 56 of the second 36 and third 52 clip members, respectively. In this embodiment, the front portion 20 may be swiveled about the fastener (e.g. rivet) between the start configuration (FIG. 2) and the angled configuration (FIG. 3). In another embodiment, the fastener 14 may be situated at about a midway point between respective proximal and distal ends of the second 36 and third 52 clip members, respectively (FIGS. 5 and 6).

Figure 4:
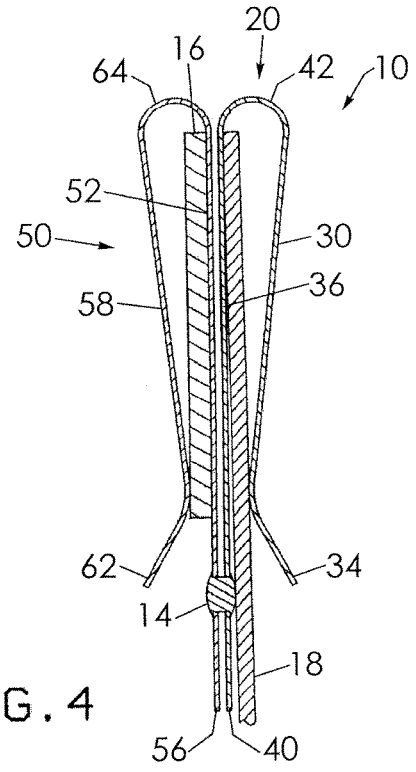
FIG. 4 is a sectional view taken along line 4-4 of FIG. 1.

In one embodiment, an area proximate the distal end 34 of the first clip member 30 may include a curved configuration that extends outwardly away from the second clip member 36 (FIGS. 2 and 3). Similarly, an area proximate the distal end 62 of the fourth clip member 58 may include a curved configuration that extends outwardly away from the third clip member 52 (FIG. 4). It can be seen in FIG. 4 that the outwardly extending areas proximate respective distal ends make it easier to insert a belt and brim of a hat in between respective rear and front portions of the hat attachment clip 10.

In another embodiment, various surfaces of respective clip members may include decorative indicia 70. The indicia 70 may include text such as advertising, a logo such as a brand name, graphics, pictures, or even sensory indicia such as Braille. In certain embodiments, other decorations may be added to provide comfort or satisfaction to a user.

In certain embodiments, the addition of a well placed magnet on one of the clips enables the double rotating clip to stay locked in compact form to prevent the double clip from rotating around in a pocket or bag while not in use but to also be easily unsnapped when ready to use.

In alternate embodiments (not shown), the hat attachment clip may be used as a rotating double sided money clip. The attachment points for both clips may be in the center back part of each clip. The first clip may have at least two additional holes just above and below the hole for the rivet that may attach both clips while the second clip may have at least two metal bumps in the casting of the clip above and below the hole where the rivet attaches both clips. The metal bumps may be aligned so that they notch into the additional holes of the first clip when the clips may be attached and facing the same direction as well as when the clips may be facing in opposite directions.

In use, the rear portion 50 of the hat attachment clip 10 may be coupled to a user's belt 16, a pants pocket, waistband, backpack, purse, or any other desired article of clothing with the front portion 20 of the hat attachment clip 10 facing outwards (FIG. 1). As described above, the configuration of the distal ends 56, 62 of respective third 52 and fourth 58 clip members enable a belt 16 to be received into the interior space 66 between the third 52 and fourth 58 clip members and to be held there securely by the biased retention force therebetween (FIG. 4). Similarly, the bill or brim of a hat 18 may be slid into the interior space 44 between the first 30 and second 36 clip members (FIG. 4). The fastener 14 enables the front portion 20 to be rotated freely so as to position the hat 1 at a desired location or configuration relative to user's body, such as to mold around a leg of the wearer.

A hat attachment clip 10' according to another embodiment of the present invention is shown in FIGS. 10*a* to 14 and includes a construction that is substantially similar to the hat attachment clip 10 described above except as specifically set for forth below. Primed reference numerals will be used with regard to this embodiment to denote structures that are substantially the same as those described previously.

The hat attachment clip 10' according to the present embodiment includes a front portion 20' and a rear portion 50' coupled together in a pivotal relationship substantially similar to that described previously except as specifically indicated below. An outer surface 37 of the second clip member 36' of the front portion 20' of the hat attachment clip 10' defines a receiving structure 72 (FIG. 10*a*) situated within the thickness of the clip member 36'. An outer surface 53 of the third clip member 52' of the rear portion 50' of the hat attachment clip 10' includes a flange 80 having a configuration complementary to a configuration of the receiving structure 72.

Figure 11A:
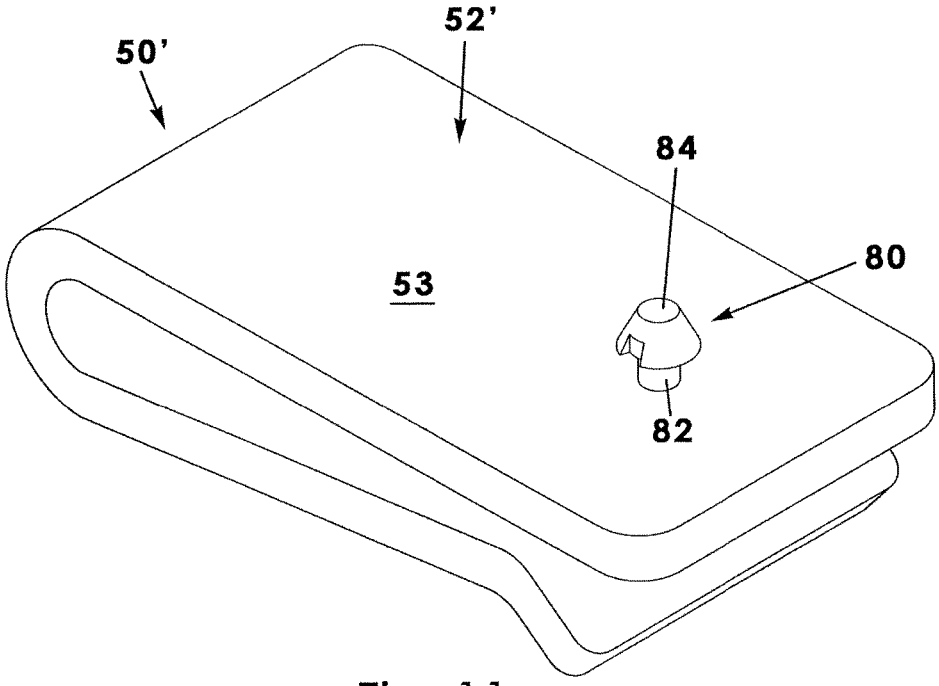
FIG. 11*a* is a perspective view of a rear portion of the hat attachment clip as in FIG. 10*a;*
Figure 11B:
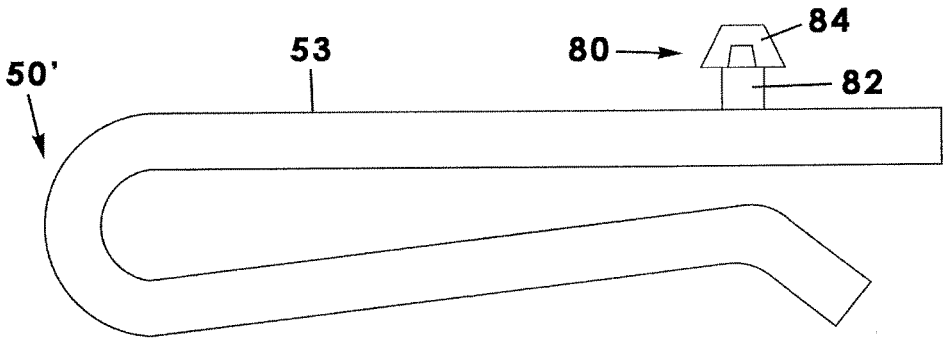
FIG. 11*b* is a side view of the rear portion as in FIG. 11*a;*
Figure 12A:
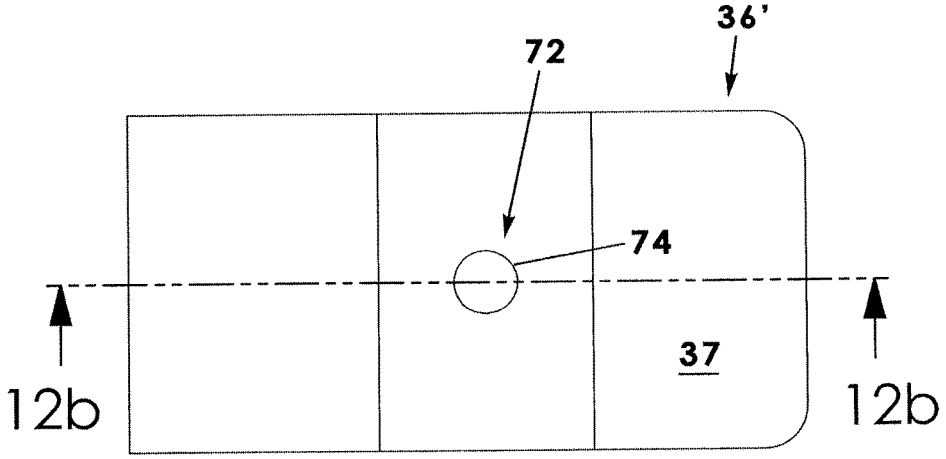
FIG. 12*a* is a bottom view of the front portion as in FIG. 10*a;*
Figure 12B:
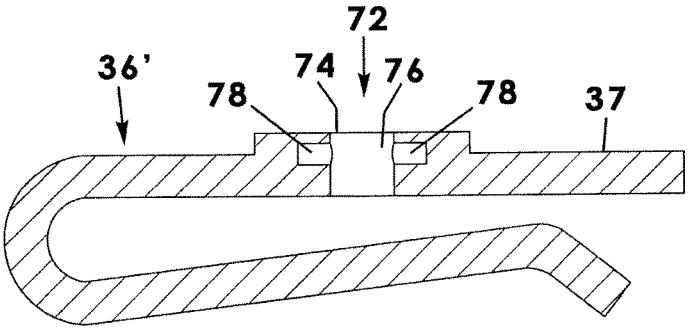
FIG. 12*b* is a sectional view taken along line 12*b*-12*b* of FIG. 12*a;*
Figure 14:
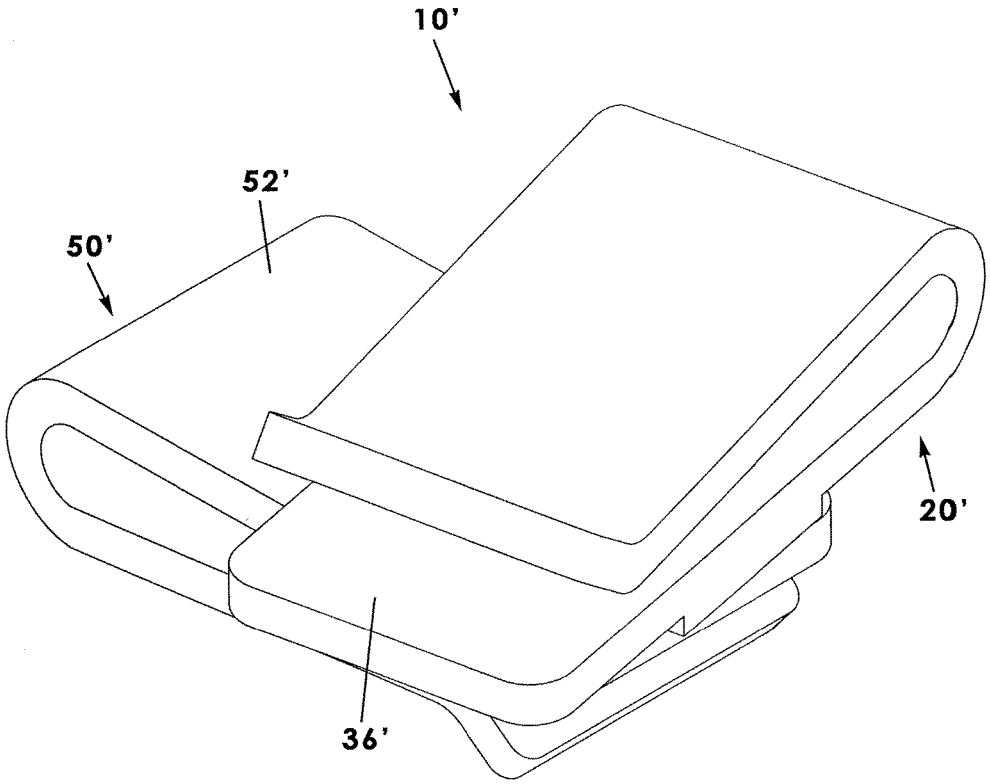
FIG. 14 is a perspective view of hat attachment clip as in FIG. 10*b* illustrated in a angled or rotated configuration.

As shown in FIGS. 11*a* and 11*b*, the flange 80 may have a post portion 82 extending away from the outer surface 53 of the third clip member 52' and having a generally cylindrical configuration. The flange 80 may also include a head portion 84 mounted atop the post portion 82, the head portion 84 having a generally frustoconical configuration although other configurations would also work. Preferably, the receiving structure 72 defines an aperture 74 in communication with an interior channel 76 having a generally cylindrical configuration (FIGS. 12*a* and 12*b*). It is understood that the interior channel 76 has a configuration complementary to that of said head portion 84 of the flange 80 so as to selectively receive the flange 80 into the channel 76 in a friction fit relationship, e.g. a snap-fit engagement. When engaged, the front portion 20' of the attachment clip 10' may be swiveled relative to the rear portion 50' of the hat attachment clip 10' in the manner described previously with regard to the hat attachment clip 10 (FIG. 14).

Figure 13A:
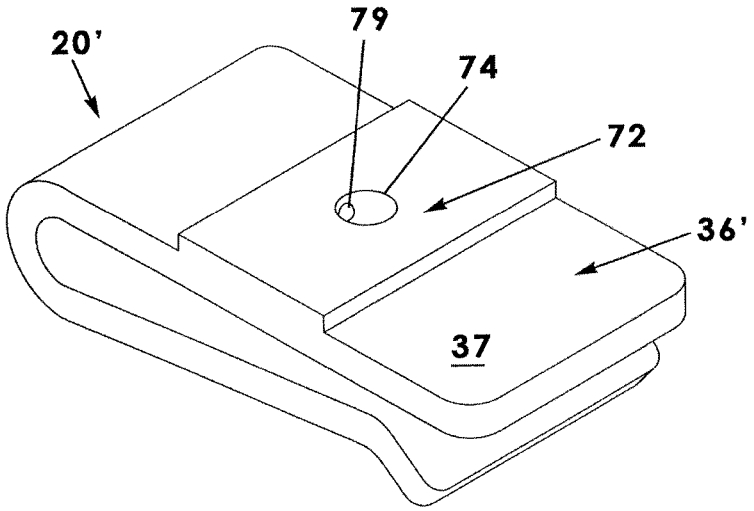
FIG. 13*a* is a perspective view of a front portion of another embodiment of the hat attachment clip.
Figure 13B:
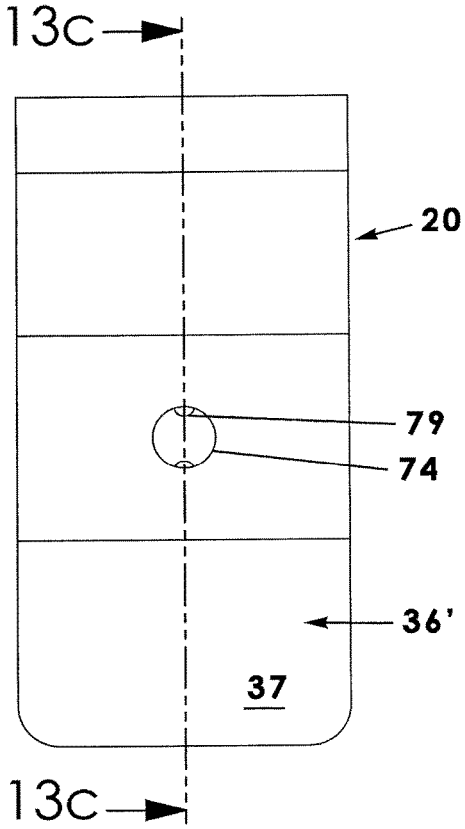
FIG. 13*b* is a top view of the front portion as in FIG. 13*a;*
Figure 13C:
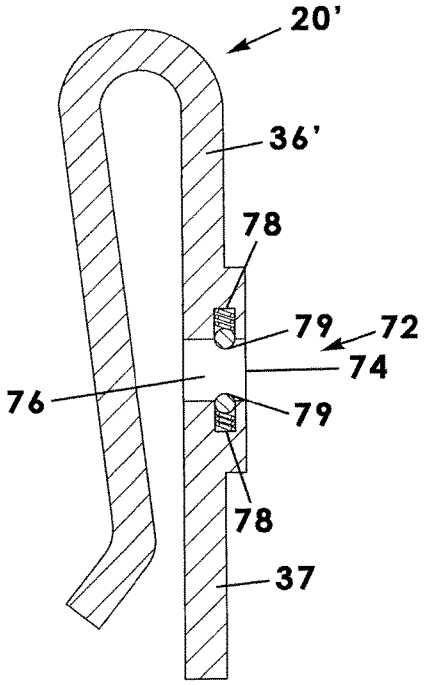
FIG. 13*c* is a sectional view taken along line 13*c*-13*c* of FIG. 13*b;*

The channel 76 may include opposed recesses 78 adjacent the aperture 74 that provides entrance to the channel 76 (FIG. 12*b*). Each recess 78 extends laterally or generally perpendicularly to the vertical channel 76. In an embodiment, one or more ball bearings 79 may be positioned in respective recesses 78 so as to enhance a tight friction fit receipt of the flange 80 into the channel 76. In addition, each ball bearing 79 may be biased outwardly into the channel 76 by one or more springs situated in a respective recess 78—again to enhance a tight friction fit receipt of the flange 80 into the channel 76 (FIG. 13*b*).

In use, the hat attachment clip 10' according to the alternative embodiment described herein includes all of the use and functionality as described previously with regard to the first embodiment (hat attachment clip 10). In addition, the front portion 20' and rear portion 50' of the hat attachment clip 10' are selectively detachable or coupled as described above. One of many examples of how the present device can be useful when the portions are separated is to use the front portion 20' as a ball marker when playing golf. More particularly, the front portion 20' may be separated from the rear portion 50' and then clipped to the brim of a golfer's hat for convenient use and then stowed again on the brim of the hat or re-attached to the rear portion 50'.

A hat attachment clip 10" according to still another embodiment of the present invention is shown in FIGS. 15 to 18 and includes a construction and structure substantially similar to the embodiment of the hat attachment clip 10' described above with regard to FIGS. 10*a* to 14 except as specifically described below. Double primed reference numerals will be used with regard to this embodiment to denote structures that are the same as structures previously described.

In the same manner described previously, the hat attachment clip 10" includes a front portion 20" and a rear portion 50" coupled together in a pivotal relationship. An outer surface 37" of the second clip member 36" of the front portion 20" of the hat attachment clip 10" defines a receiving structure 72". The receiving structure 72" includes a generally circular aperture 74" in communication with the channel described previously. An outer surface 53" of the third clip member 52" of the rear portion 50" of the hat attachment clip 10" includes a flange 80" having a configuration complementary to the configuration of the aperture 74". In the same manner as disclosed with respect to the first embodiment described above and shown in FIGS. 1 to 4, the attachment of the front portion 20" and rear portion 50" defines a space between the second clip member 36" and third clip member 52" when coupled together for pivotal rotation or swivel.

Figure 17A:
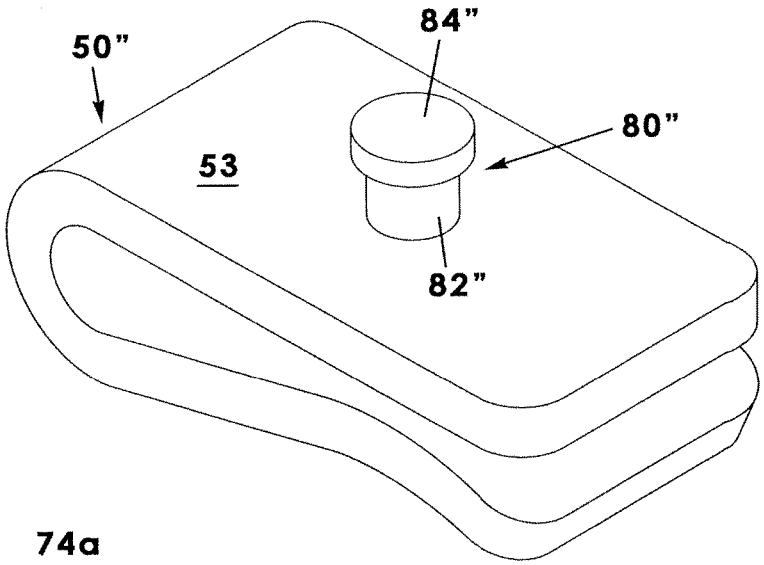
FIG. 17*a* is a perspective view of the rear portion of the hat attachment clip of FIG. 15 illustrated in an inverted position for clarity.

The flange 80" may include a post portion 82" extending away from the outer surface 53" of the third clip member 52" having a generally cylindrical configuration (FIG. 17*a*). The flange 80" may also include a head portion 84" mounted atop the post portion 82" that includes a configuration complementary to a configuration of the aperture 74" so as to be selectively received therein when coupling the first portion 20" to the second portion 50" of the hat attachment clip 10". The dimensions of the aperture 74" and flange 80" are configured to allow the first portion 20" and the second portion 50" of the hat attachment clip 10" to pivot or swivel rotationally when coupled together, as described previously.

Figure 17B:
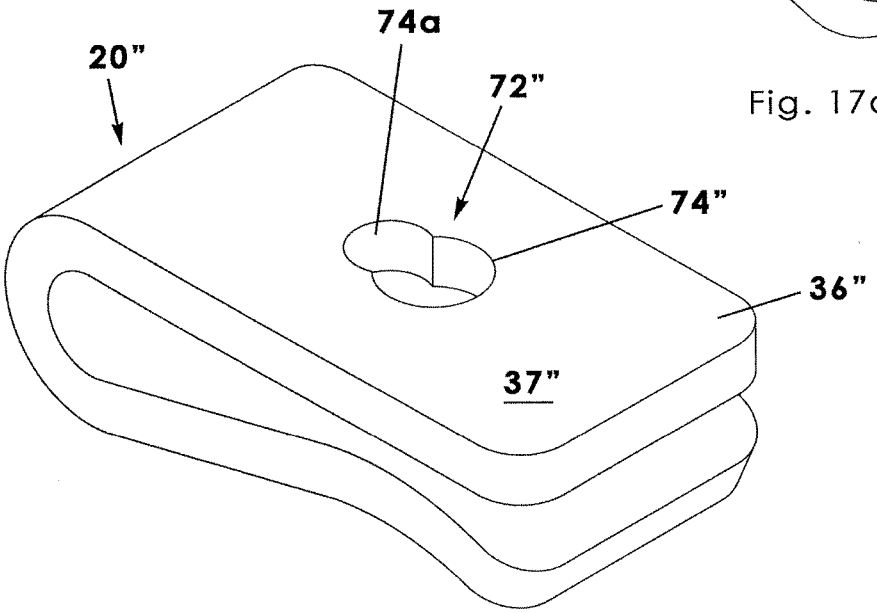
FIG. 17*b* is a perspective view of the front portion of the hat attachment clip of FIG. 15.
Figure 18:
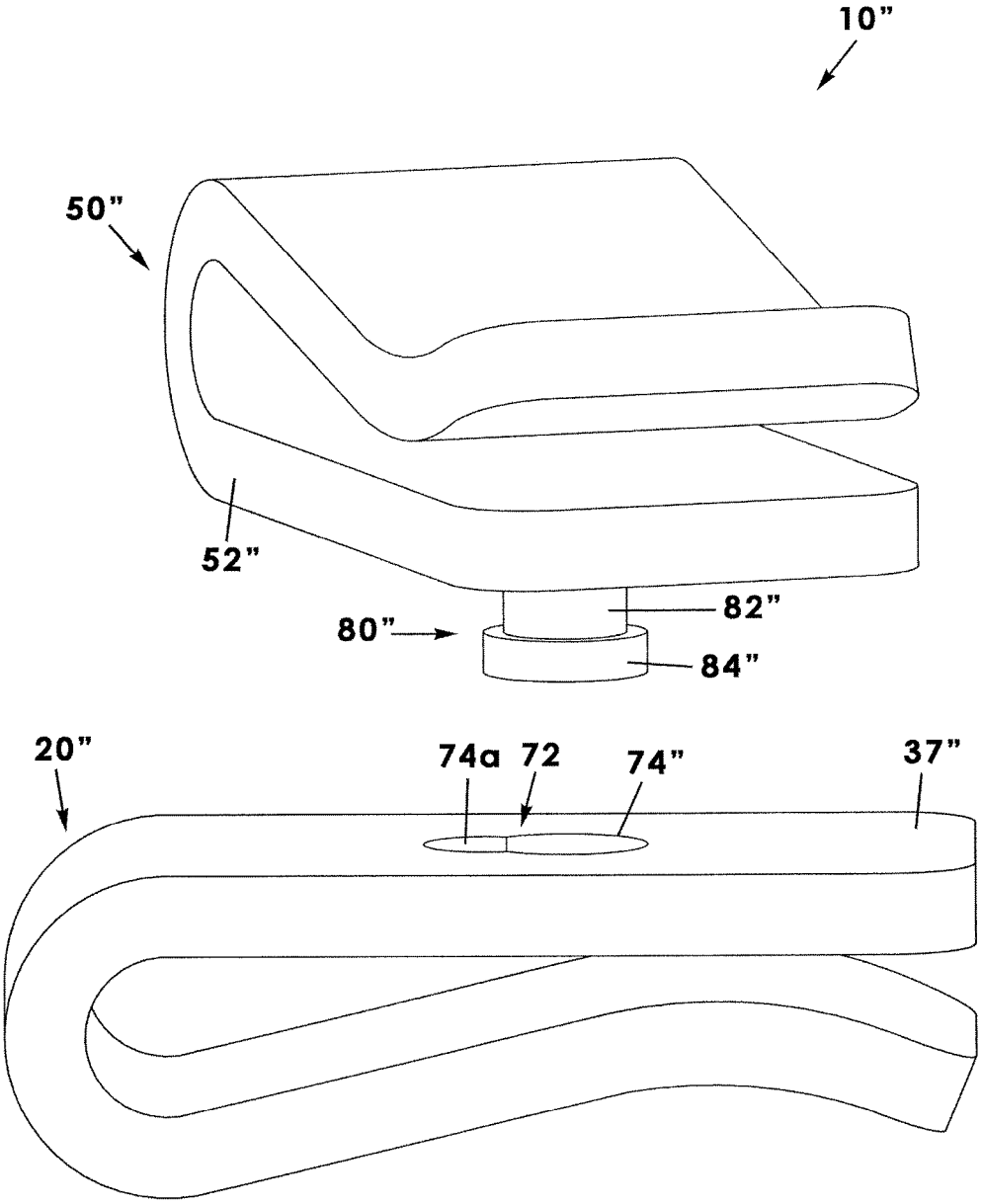
FIG. 18 is an exploded view of a hat attachment clip as in claim 15.
Figure 19:
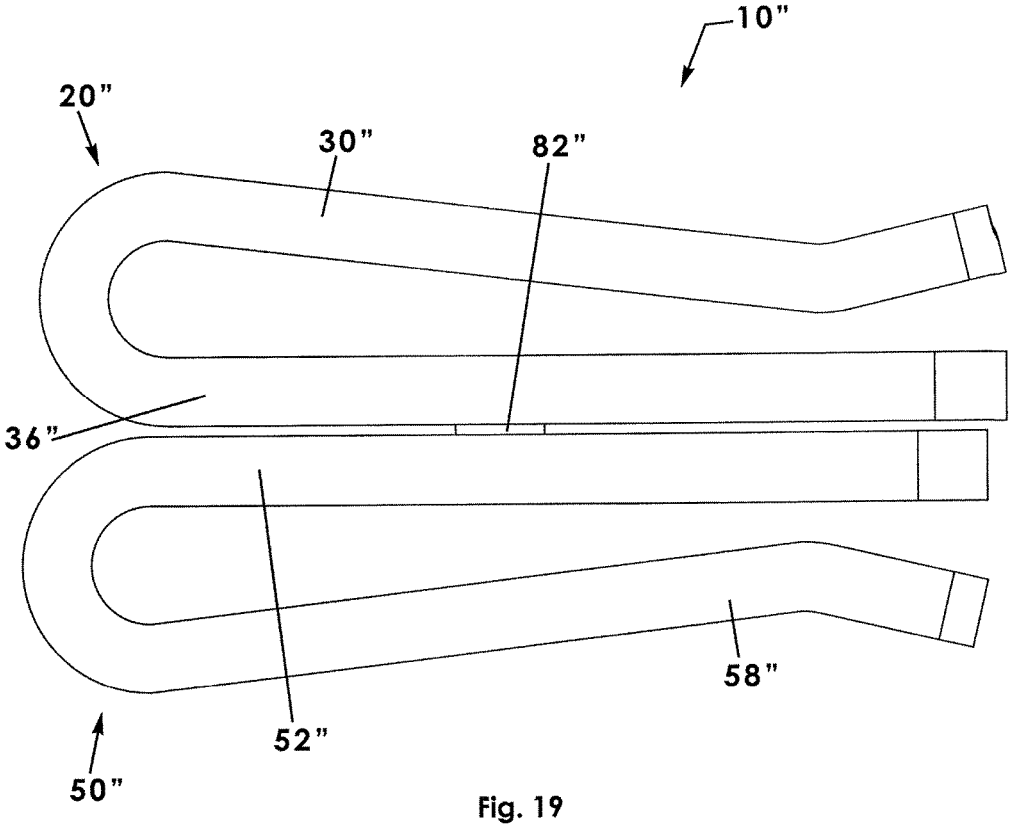
FIG. 19 is a side view of the hat attachment clip shown in FIG. 15.

The receiving structure 72" may define a slot 74*a* adjacent to and in communication with the aperture 74" (FIG. 17*b*). The slot 74*a* and aperture 74" may together be referred to as having a keyhole configuration. The slot 74*a* includes a dimension that is complementary to that of the post portion 82" of the flange 80" and is configured to selectively receive the post portion 82" therein in a generally friction fit engagement.

Figure 15:
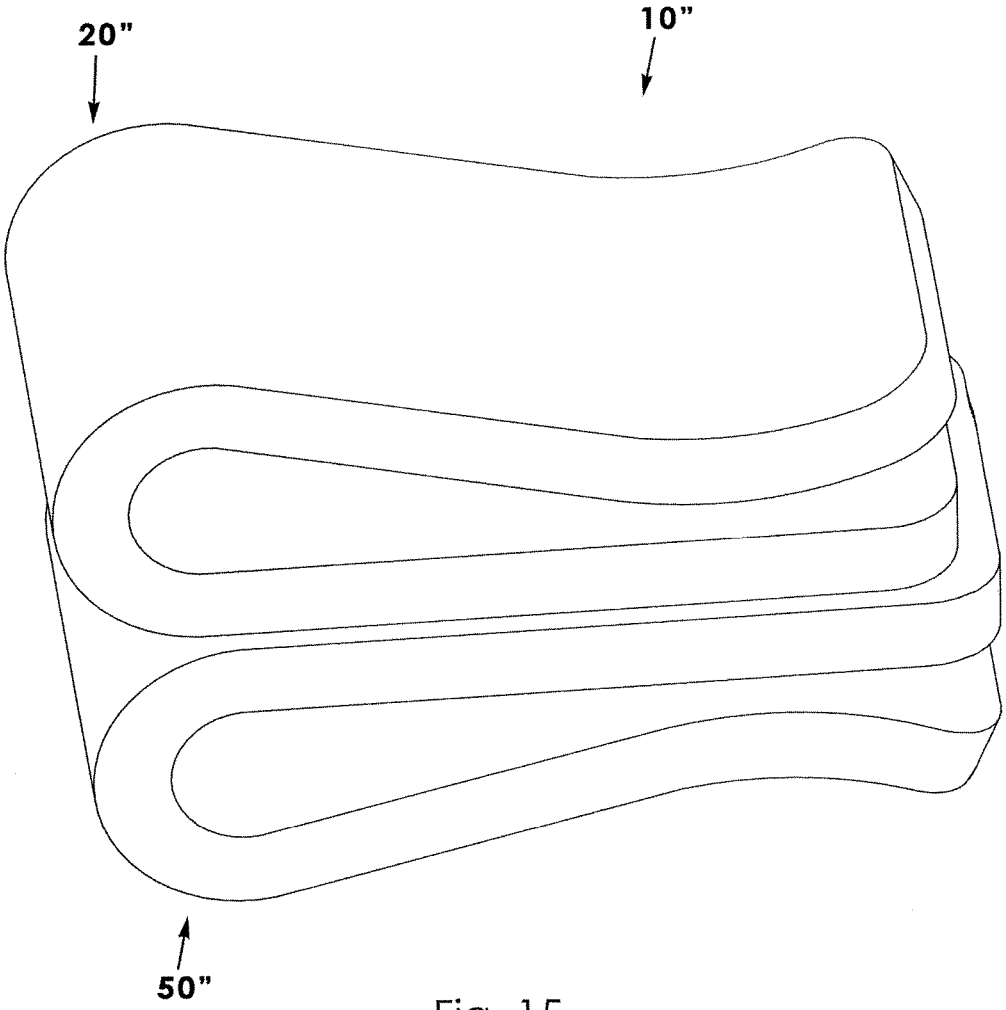
FIG. 15 is a perspective view of a hat attachment clip according to another embodiment of the present invention.
Figure 16:
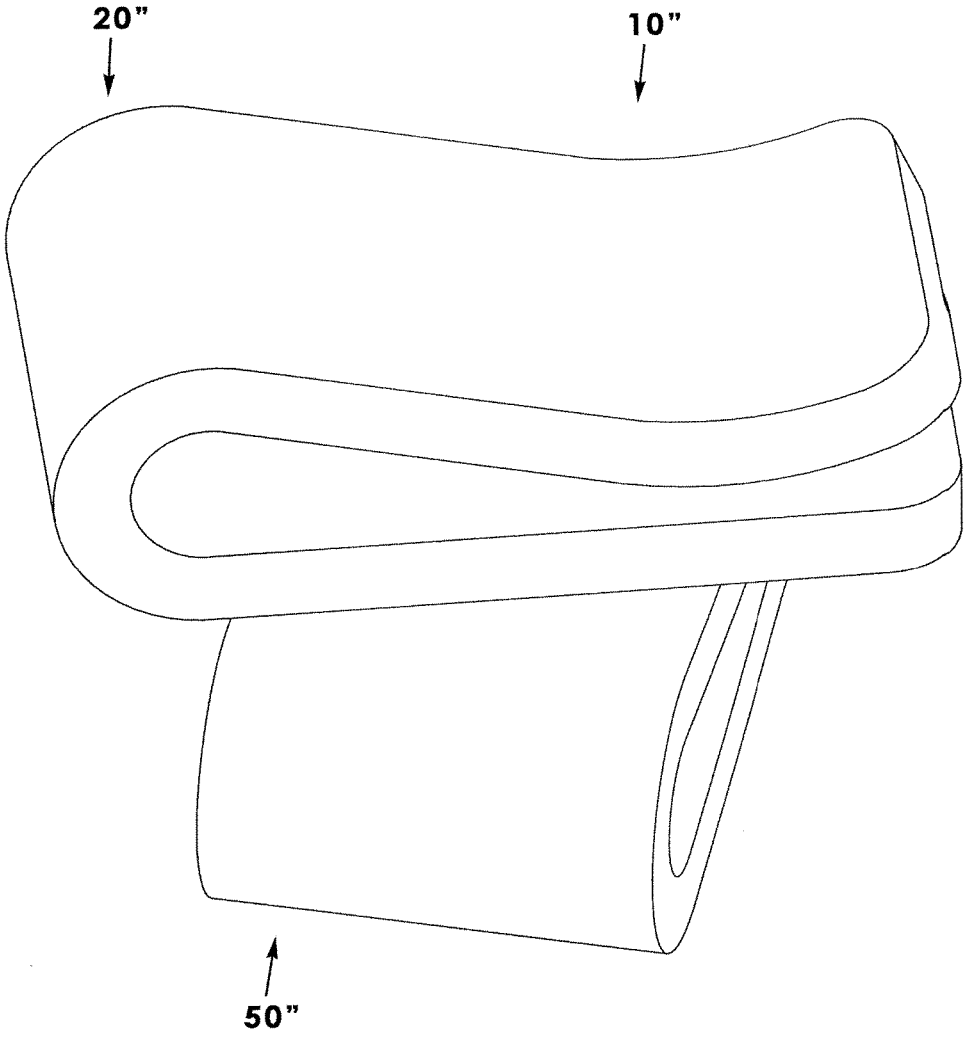
FIG. 16 is another perspective view of the hat attachment clip as in FIG. 15 illustrated with the front and rear portions thereof in a rotated configuration.

In use, the hat attachment clip 10" according to the alternative embodiment shown in FIGS. 15 to 17 includes all of the use and functionality of the hat attachment clip 10' shown in FIGS. 10 to 14, including being detachable from one another. In addition, the keyhole style aperture 74" and slot 74*a* configuration of the receiving structure 72" enable the flange 80" to be held therein in a light friction fit manner, such as to prevent inadvertent or unintended detachment of the first portion 20" and rear portion 50" of the clip hat attachment 10". Specifically, the flange 80" may be inserted into the aperture 74" and then the post portion 82" slidably urged into the slot 74*a* in a snap fit or lightly friction fit engagement.

It is understood that while certain forms of this invention have been illustrated and described, it is not limited thereto except insofar as such limitations are included in the following claims and allowable functional equivalents thereof.

The invention claimed is:

1. A hat attachment clip for use with a hat having a brim and for use with the belt of a person's apparel, comprising:

a front portion comprising:

a first clip member having opposed proximal and distal ends;

a second clip member having opposed proximal and distal ends;

a first bridge member coupling said proximal ends of said first clip member and said second clip member, respectively, in a unitary closed arrangement;

wherein said first clip member defines a first open space between said first clip member and said second member proximate said first bridge member;

wherein said distal ends of said first clip member and said second clip member, respectively, are constructed of a material that exerts a retentive force so as to be normally biased toward one another;

a rear portion releasably coupled to said front portion, comprising:

a third clip member having opposed proximal and distal ends;

a fourth clip member having opposed proximal and distal ends;

a second bridge member coupling said proximal ends of said third clip member and said fourth clip member, respectively, in a unitary closed arrangement;

wherein said third clip member defines a second open space between said third clip member and said fourth member proximate said second bridge member;

wherein said second clip member is displaced from said third clip member so as to define a space between said front portion and said rear portion;

wherein said distal ends of said third clip member and said fourth clip member, respectively, are normally biased toward one another;

wherein said front portion includes a configuration that is substantially identical as a configuration of said rear portion;

wherein:

said front portion defines a first longitudinal axis;

said rear portion defines a second longitudinal axis; and said front portion is rotatably coupled to said rear portion such that said front portion is movable between a start configuration at which said first longitudinal axis is parallel to said second longitudinal axis and an angled configuration at which said second axis is rotatably displaced from said first axis;

said distal end of said first clip member is adjacent said distal end of said third clip member when said front portion is at said start configuration and is swiveled away from said distal end of said third clip member at said angled configuration;

said distal end of said first clip member is positioned along said first longitudinal axis and parallel to said second longitudinal axis but longitudinally displaced from said distal end of said third clip member when said front portion is at said start configuration and is swiveled away from said distal end of said third clip member at said angled configuration;

an outer surface of said second clip member includes a receiving structure that defines an aperture in communication with a channel;

a flange extends away from an outer surface of said third clip member, said flange having a configuration that is selectively received into said channel in a selectively releasable friction fit engagement.

2. The hat attachment clip as in claim 1, wherein said flange includes a post portion coupled to said outer surface of said third clip member that extends away therefrom and a head portion mounted atop said post portion, said head portion having a generally frustoconical configuration that is complementary to a configuration of said channel and is selectively received therein in a friction fit engagement.

3. The hat attachment clip as in claim 1, wherein:

said channel defines a recess adjacent said aperture;

said receiving structure includes a ball bearing situated in said recess so as to enhance receipt of said flange in a friction fit engagement.

4. The hat attachment clip as in claim 3, wherein said ball bearing is biased toward said channel and configured to bear against said flange when said flange is positioned in said channel.

5. The hat attachment clip as in claim 4, wherein:

said distal ends of said first clip member and said second clip are movable between a closed configuration blocking the brim of the hat from being inserted therebetween into said first open space and an open configuration receiving the brim of the hat into said first open space; and said distal ends of said third clip member and said fourth clip member are movable between a closed configuration blocking the belt from being received therebetween into said second open space and an open configuration receiving the belt into said second open space.

6. The hat attachment clip as in claim 1, wherein:

said distal ends of said first clip member and said second clip member are movable between a closed configuration blocking the brim of the hat from being inserted therebetween into said first open space and an open configuration receiving the brim of the hat into said first open space; and said distal ends of said third clip member and said fourth clip member are movable between a closed configuration blocking the belt from being received therebetween into said second open space and an open configuration receiving the belt into said second open space.

7. The hat attachment clip as in claim 5, wherein:

said front portion defines a first longitudinal axis;

said rear portion defines a second longitudinal axis; and said front portion is rotatably coupled to said rear portion such that said front portion is movable between a start configuration at which said first longitudinal axis is parallel to said second longitudinal axis and an angled configuration at which said second axis is rotatably displaced from said first axis.

8. The hat attachment clip as in claim 7, wherein said distal end of said first clip member is positioned along said first longitudinal axis and parallel to said second longitudinal axis but longitudinally displaced from said distal end of said third clip member when said front portion is at said start configuration and is swiveled away from said distal end of said third clip member at said angled configuration.

9. The hat attachment clip as in claim 5, wherein said fastener is situated generally at a midpoint between said respective proximal and distal ends of said second clip member and said third clip member.

10. The hat attachment clip as in claim 1, wherein said distal end of said first clip member has a curved configuration that extends outwardly away from said distal end of said second clip member.

11. The hat attachment clip as in claim 10, wherein said distal end of said fourth clip member has a curved configuration that extends outwardly away from said distal end of said third clip member.

12. The hat attachment clip as in claim 1, wherein said first clip member includes decorative indicia.

13. The hat attachment clip as in claim 1, wherein said flange includes a post portion coupled to said outer surface of said third clip member that extends away therefrom and a head portion mounted atop said post portion, said head portion having a configuration that is complementary to a configuration of said aperture of said receiving structure and is selectively received into said channel through said aperture.

14. The hat attachment clip as in claim 13, wherein said receiving structure defines a slot adjacent to and in communication with said aperture, said slot configured to selectively receive said post portion of said flange in a friction fit engagement.

15. The hat attachment clip as in claim 6, wherein:

said flange includes a post portion coupled to said outer surface of said third clip member that extends away therefrom and a head portion mounted atop said post portion, said head portion having a configuration that is complementary to a configuration of said aperture of said receiving structure and is selectively received into said channel through said aperture; and said receiving structure defines a slot adjacent to and in communication with said aperture, said slot configured to selectively receive said post portion of said flange in a friction fit engagement.

* * * * *